US007270354B2

(12) United States Patent
Soumar

(10) Patent No.: US 7,270,354 B2
(45) Date of Patent: Sep. 18, 2007

(54) LOCKING DEVICE

(76) Inventor: Radovan Soumar, 15 Middle Oxbox Rd., Hindsdale, NH (US) 03451

( * ) Notice: Subject to any disclaimer, the term of this patent is extended or adjusted under 35 U.S.C. 154(b) by 0 days.

(21) Appl. No.: 11/295,918

(22) Filed: Dec. 7, 2005

(65) Prior Publication Data

US 2007/0138809 A1 Jun. 21, 2007

(51) Int. Cl.
*E05B 39/02* (2006.01)

(52) U.S. Cl. ..... 292/329; 292/327; 292/283; 292/284

(58) Field of Classification Search ..... 292/329, 292/327, 328, DIG. 17, 205, DIG. 15, 207, 292/283, 284, 282; 70/2, 6–13, 31–34
See application file for complete search history.

(56) References Cited

U.S. PATENT DOCUMENTS 579,990 A * 4/1897 Lampus ..... 293/35
1,627,752 A * 5/1927 Small ..... 292/281
3,591,219 A * 7/1971 Graziosi ..... 292/207
3,869,162 A * 3/1975 Schuller ..... 292/283
4,013,311 A * 3/1977 Prezioso ..... 292/59
4,462,233 A * 7/1984 Horetzke ..... 70/428
4,844,519 A * 7/1989 Dagon ..... 292/57
4,898,008 A * 2/1990 Eberly ..... 70/56
5,782,507 A * 7/1998 Hardee ..... 292/267
6,463,769 B1 * 10/2002 Garner ..... 70/56

* cited by examiner

*Primary Examiner*—Brian E. Glessner
*Assistant Examiner*—Mark Williams
(74) *Attorney, Agent, or Firm*—Bourque and Associates

(57) ABSTRACT

A locking device having an upper portion, a lower portion, and a locking arm prevents a closed door from being opened. The locking arm is pivotably mounted to the lower portion of the locking device and positioned in cavities of the upper portion and the lower portion. A pivot bolt is operatively attached to the lower portion and an end of the locking arm. A locking bolt extends transverse and through the locking arm and through the lower portion for securing the locking arm. The locking bolt has a key or detent, which is received by a corresponding groove in the lower portion. The locking arm extends vertically from the lower portion upwardly above the lower edge of the door, thereby preventing the door from being opened outwardly when in a closed position. The upper portion and the lower portion are preferably bulbous shaped.

10 Claims, 3 Drawing Sheets

LOCKING DEVICE

TECHNICAL FIELD OF THE INVENTION

The present invention relates to a locking device and more particularly, to a locking device for locking a pair of adjacent, pivotally mounted doors that close at a common line.

DESCRIPTION OF THE RELATED ART

Door securing or latching devices for truck and trailer cargo doors are typically of two types. In one type, commonly used with roll-up doors, a pivoted latch handle is mounted proximate a bottom of the roll-up door. A latch hook opposite the latch handle is used for securing the roll-up door to a frame or body of the truck in the closed position. In the other type, commonly used with swinging-type doors, a rod having latch lugs at its ends is mounted on a door and when the door is to be secured, the rod is rotated by a latch handle attached thereto, so as to cause the latch lugs to engage corresponding catches on the truck or trailer body. The present invention is practiced with and relates to these swinging-type doors.

The swinging-type doors have a latching action employed that is commonly overcenter, such that the doors remain latched until the latch handle is manually moved to an unlatching position. In order to prevent unauthorized access to the cargo area, the door latch may typically be provided with means for securing the latch handle to prevent its movement to an unlatched position. Commonly utilized latch handle securing means may typically include a staple tab or ear on the latch handle which aligns with a corresponding staple tab mounted on the door when the latch handle is in a latched position, so that a shackle of a padlock may be passed through the aligned staple tabs to secure the latch handle in its latched position.

In another approach to attempt to preclude unauthorized entry to the swinging-type doors, staple tabs are mounted to the latch rod of each door. When the doors are to be latched, the staple tabs on each of the door's latch rod are brought into adjacent alignment permitting a padlock shackle to be passed therethrough to prevent the latch rods from being rotated to an unlatching position.

Such door latch securing means have a number of disadvantages. The staple tabs are typically neither robustly mounted nor of robust construction. The latch handle, being a lever, provides a means for an unauthorized user to apply considerable force upon the latch using the latch handle as a means of grasping or permitting the application of tools to break the staple tab. It is known, for example, to slip a pipe over the end of the latch handle to obtain significant leverage, thereby applying a force sufficient to break the staple tabs. Further, unauthorized entry has been gained by using a prybar to pry a staple tab loose from its mounting, or by using a chisel to cut a staple tab off.

The padlock used to secure the door latch is also vulnerable to tampering. It is well known, for example, to use bolt-cutting tools, saws, and cutting torches to cut through the shackle of a padlock, thus permitting its removal. In other instances, Freon is used to freeze the padlock, and a force is applied the padlock to shatter it. In still other instances, hammers and sledgehammers have been used to strike the padlock to disengage the internal locking mechanism.

Freight shipments of goods and equipment may often be valued in millions of dollars, and it thus becomes desirable to provide a locking device for locking a pair of adjacent, pivotally mounted doors that close at a common line effectively securing cargo compartments against unauthorized access which overcome the disadvantages of known locking means and which resist attempted tampering.

SUMMARY OF THE INVENTION

The present invention features a locking device having an upper portion, a lower portion, and a locking arm for preventing a closed door from being opened. The locking arm is pivotably mounted to the lower portion of the locking device. In a locking position, the locking arm is positioned in cavities of the upper portion and the lower portion of the locking device. A pivot bolt is operatively attached to the lower portion and an end of the locking arm. The locking arm may pivot about the pivot bolt when in an unlocked position. A locking bolt extends transverse and through the locking arm and through the lower portion in the locked position. The locking bolt has a key or detent, which is received by a corresponding groove in the lower portion. In the locked position, the locking arm extends vertically from the lower portion upwardly beyond a lower edge of the door, thereby preventing the door in the closed position from being opened outwardly.

It is important to note that the present invention is not intended to be limited to a device, which must satisfy one or more of any stated objects or features of the invention. It is also important to note that the present invention is not limited to the preferred, exemplary, or primary embodiment(s) described herein. For example, although the present invention is explained in the context of cargo trailers, this is not a limitation of the present invention as the invention may be utilized on many devices. Modifications and substitutions by one of ordinary skill in the art are considered to be within the scope of the present invention.

BRIEF DESCRIPTION OF THE DRAWINGS

These and other features and advantages of the present invention will be better understood by reading the following detailed description, taken together with the drawings wherein.

DETAILED DESCRIPTION

In the following detailed description, the term "truck" refers to any truck, trailer, semi-trailer, rail car, building or enclosure and the like having an enclosed storage, cargo or freight compartment equipped with doors for access thereinto.

Figure 1:
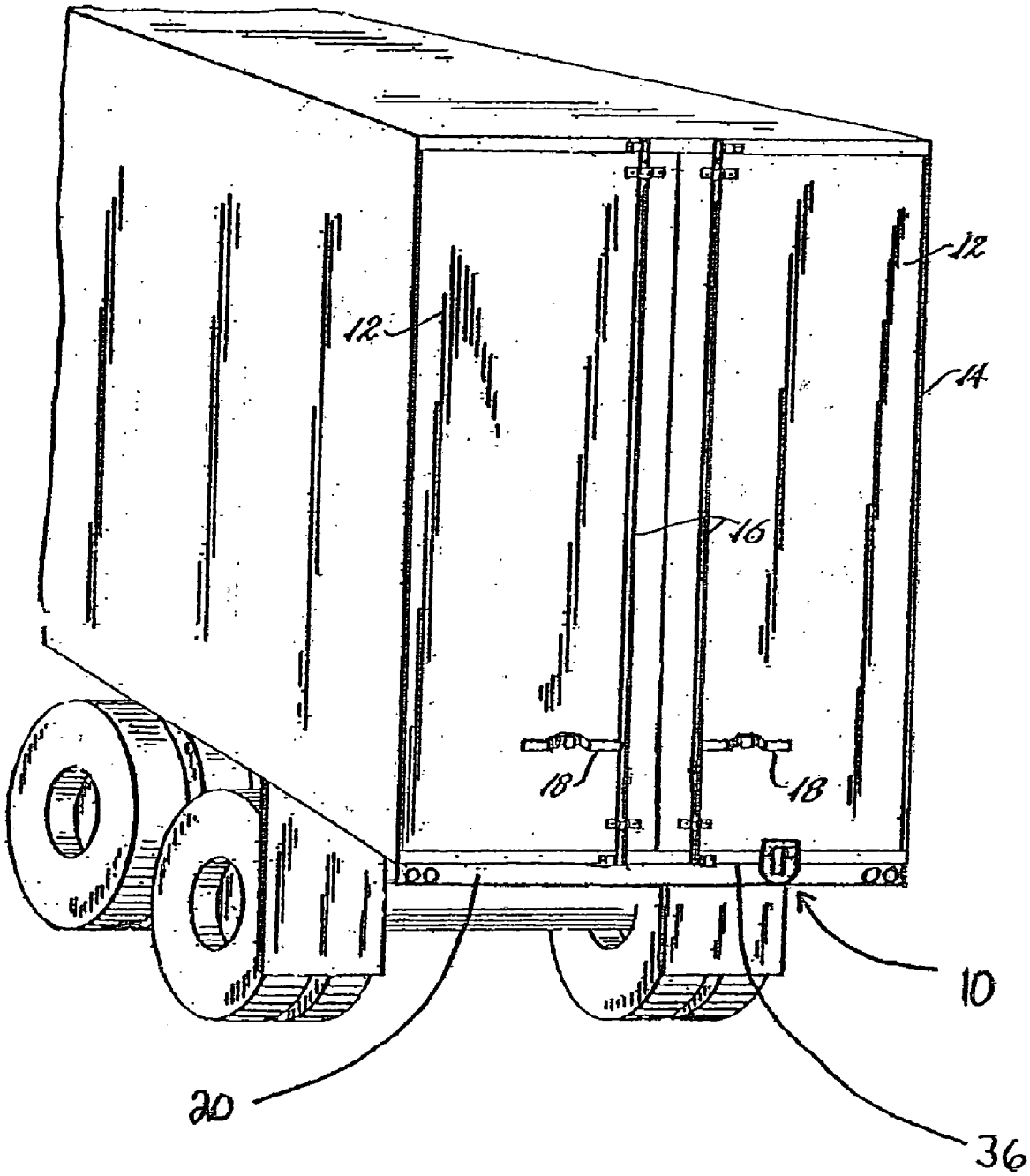
FIG. 1 is a perspective view of a semi-trailer having a locking device according to the present invention attached thereto.

The present invention features a locking device, indicated generally at 10, FIG. 1, installed on one or more of center-opening swinging cargo doors 12 and frame 20 of a truck 14. Swinging-type cargo doors 12 are typically provided with latch rods 16 at ends of which are carried latch lugs (not shown) as is well known in the art. When the doors 12 are closed, the latch rods 16 may be rotated by latch handles 18 integral therewith to bring the latch lugs into latching engagement with corresponding catches (not shown) carried on a body of the truck 14. In this latched condition, the latch handles 18 extend generally parallel to exterior surfaces of the doors 12.

The latching action employed is commonly overcenter so that once latched, the doors 12 will remain closed until the latch handles 18 are manually moved to an unlatching position. The latch handles 18 must be moved outwardly from its parallel position with respect to door 12 in order to rotate the latch rod 16 to disengage the latch lugs from the catches so that the doors 12 may be opened.

The problem with this arrangement is its vulnerability to tampering and break-in. For example, a padlock is typically used to secure the doors 12, and as explained in the Description of the Related Art, the padlock is vulnerable to tampering. Bolt-cutting tools, saws, and cutting torches have been used to cut through the shackle of a padlock, thus permitting the removal of the padlock. In other instances, the latch handles 18 have been used as a lever by an unauthorized user to apply considerable force upon the latch handles 18. Further, a pipe has been slipped over the ends of the latch handles 18 to obtain great leverage to apply a force that will break the staple tabs and the padlock.

To overcome the disadvantages in the prior art, the locking device 10 of the present invention may be installed on and between one or more of the doors 12 and the frame 20 of the truck 14. The locking device 10 of the present invention is operable to secure the doors 12 of the truck 14 in a closed and latched position by preventing the doors 12 from opening and thus precluding the latch handles 18 from being moved to an unlatching position.

Figure 2:
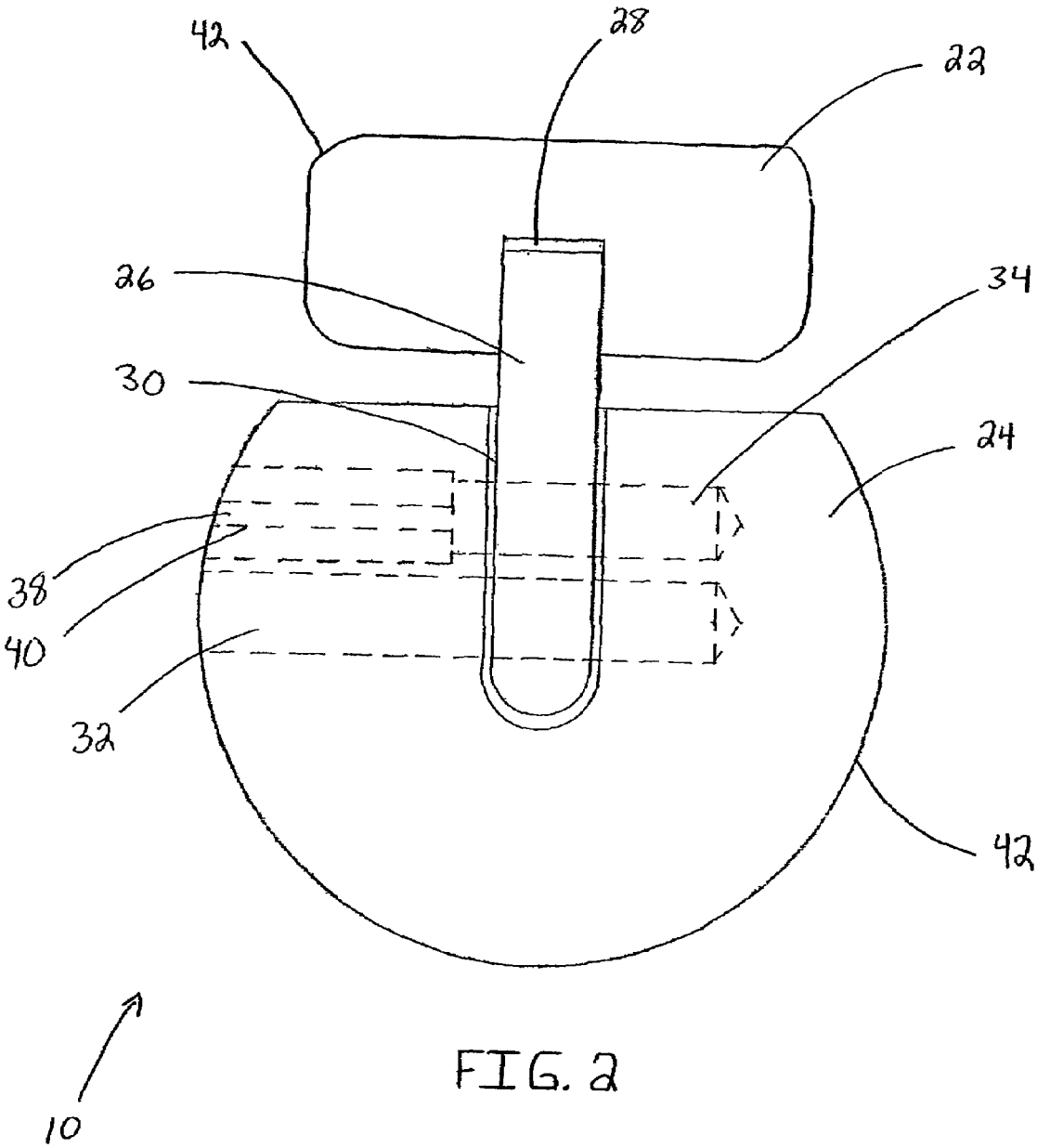
FIG. 2 is front view of the locking device shown in FIG. 1 according to the present invention.

The locking device 10, FIG. 2, has an upper portion 22 operatively attached to the cargo door 12. The locking device 10 also has a lower portion 24 operatively attached to the frame 20 of the truck 14. In the preferred embodiment, the upper portion 22 and the lower portion 24 are rounded or have a bulbous shape 42 to deflect any force applied to them, thereby reducing the probability of unauthorized entry to the truck 14.

Figure 3:
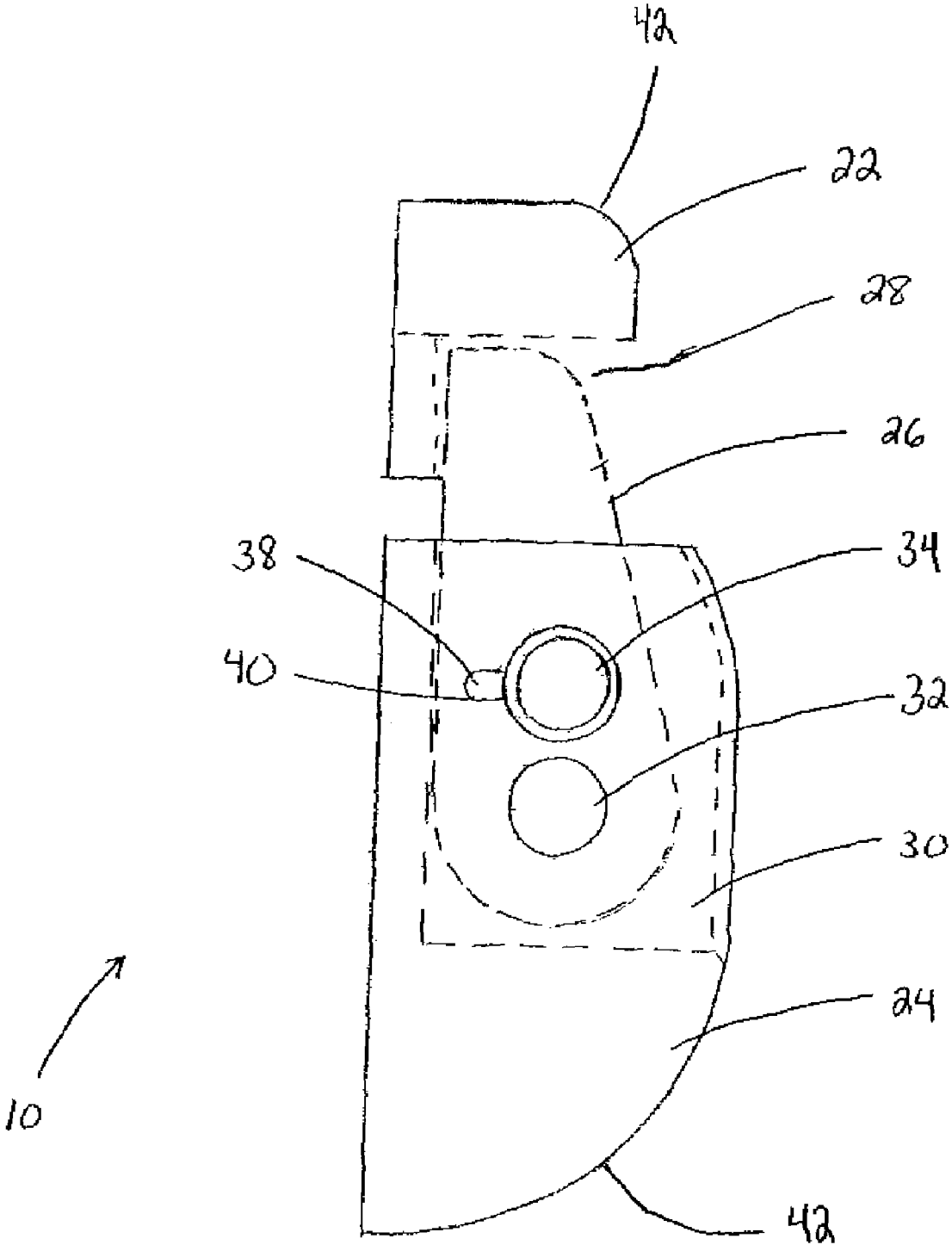
FIG. 3 is a side view of the locking device shown in FIGS. 1 and 2 according to the present invention.

In the preferred embodiment, a locking arm 26 is pivotably mounted to the lower portion 24 of the locking device 10, FIGS. 2 and 3. A pivot bolt 32 is inserted through the lower portion 24 and an end 44 of the locking arm 26, and the locking arm 26 pivots about the pivot bolt 32. However, in an alternative embodiment, the locking arm 26 rests in cavities 28, 30 of the upper portion 22 and the lower portion 24, respectively, without pivoting about the pivot bolt 32. In still another embodiment, the locking device 10 may be used without the upper portion 22.

A locking bolt 34 is used to lock the locking arm 26 in place. The locking bolt 34 is placed through the bottom portion 24 and the locking arm 26 and extends horizontally and transverse to the locking arm 26. Once the locking bolt 34 is locked in place, the locking arm 26 rests in the cavities 28, 30 and is secured thereto. The locking arm 26 extends vertically from an area proximate the frame 20 to vertically above a bottom edge 36 of the door 12, thereby precluding the door 12 from opening.

To prevent the locking bolt 34 from being removed by an authorized user, the locking bolt 34 has a protrusion 38 or is keyed, such that unauthorized removal is precluded. A tool having an aperture that receives a head of the locking bolt 34 and the detent 38 or that fits into an aperture in the head of the locking bolt 34, is used to insert the locking bolt 34 through the bottom portion 24 and the locking arm 26. The tool is then used to turn the detent 38 of the locking bolt 34 into a corresponding key groove 40 in the lower portion 24, such that the locking bolt 34 cannot be removed without the tool. The corresponding groove 40 is generally "L" shaped.

Modifications and substitutions by one of ordinary skill in the art are considered to be within the scope of the present invention, which is not to be limited except by the following claims.

What is claimed is:

1. A locking device, comprising:

an upper portion having a cavity, and a lower portion having a cavity;

a locking arm pivotably mounted to the lower portion of the locking device and in use positionable in the cavities of the upper portion and the lower portion;

a pivot bolt operatively attached to the lower portion and pivotabley mounting an end of the locking arm to the lower portion; and a locking bolt extending transverse and through the locking arm, and through the lower portion for securing the locking arm, wherein the locking bolt has a detent received by a corresponding groove in the lower portion.

2. The locking device according to claim 1, wherein the upper portion and the lower portion are bulbous shaped.

3. The locking device according to claim 1, wherein the door has a lower edge, and the locking arm extends vertically from the lower portion upwardly beyond the lower edge of the door, thereby preventing the door from being opened outwardly when in a closed position.

4. The locking device according to claim 1, wherein the upper portion of the locking device is operatively mounted to the door of a truck, and the lower portion is operatively mounted to a frame of the truck.

5. A locking device, comprising:

a mounting plate operatively mounted to a frame of a truck;

a locking arm pivotably mounted within a cavity in the mounting plate and configured for extending from the cavity in the mounting plate in a vertical direction above a bottom edge of a swinging type door of a truck;

a pivot bolt operatively mounted to a first end of the locking arm; and a locking bolt operatively mounted between a first end and a second end of the locking arm, wherein the locking bolt has a detent received by a corresponding groove in the mounting plate.

6. The locking device according to claim 5, wherein the mounting plate is bulbous shaped.

7. A locking a pair of adjacent, pivotally mounted doors that close at a common line comprising:

an upper portion configured for being operatively attached to a bottom end of at least one of the pair of adjacent, pivotally mounted swinging doors that close at a common line;

a lower portion configured for being operatively attached below the bottom end of at said least one door of the pair of adjacent, pivotally mounted swinging doors;

a locking arm disposed in a cavity of the upper portion and the lower portion, and rotatably mounted to a pivot bolt in said lower portion;

a locking bolt inserted through openings in the lower portion and the locking arm; and a key disposed on the locking bolt received by a corresponding groove in the lower portion.

8. The locking device according to claim 7, wherein the upper portion and the lower portion are bulbous shaped.

9. The locking device according to claim 7, wherein the at least one door has a lower edge, and the locking arm extends vertically from the lower portion upwardly beyond the lower edge of the door, thereby preventing the door from being opened outwardly when in a closed position.

10. The locking device according to claim 7, wherein the upper portion of the locking device is operatively mounted to the at least one swinging door of a truck, and the lower portion is operatively mounted to a frame of the truck.

* * * * *